United States Patent [19]

Fronius

[11] Patent Number: 4,685,165

[45] Date of Patent: Aug. 11, 1987

[54] HAIR BRUSH

[75] Inventor: Joe E. Fronius, Excelsior, Minn.

[73] Assignee: Turn-N-Tame Inc., Minneapolis, Minn.

[21] Appl. No.: 803,114

[22] Filed: Nov. 29, 1985

Related U.S. Application Data

[63] Continuation-in-part of Ser. No. 649,915, Sep. 12, 1984, abandoned, which is a continuation-in-part of Ser. No. 643,841, Aug. 23, 1984, abandoned, which is a continuation-in-part of Ser. No. 598,518, Apr. 9, 1984, abandoned.

[51] Int. Cl.[4] ..... A46B 7/10

[52] U.S. Cl. ..... 15/27; 15/187; 132/85; 242/84.5 R

[58] Field of Search ..... 15/27, 160, 186–188; 188/83; 242/84.5 R; 132/85, 118

[56] References Cited

U.S. PATENT DOCUMENTS

| | | | |
|---|---|---|---|
| 2,279,434 | 4/1942 | Balz | 242/84.5 R |
| 2,347,173 | 4/1944 | Coxe et al. | 242/84.5 R |
| 3,843,990 | 10/1974 | Lardenois | 132/85 |
| 4,197,608 | 4/1980 | Holley et al. | 15/27 |
| 4,469,934 | 9/1984 | Isshiki et al. | 15/27 |

FOREIGN PATENT DOCUMENTS

| | | | |
|---|---|---|---|
| 2364229 | 7/1974 | Fed. Rep. of Germany | 15/27 |
| 1222686 | 1/1960 | France | 15/27 |

*Primary Examiner*—Peter Feldman

*Attorney, Agent, or Firm*—Merchant, Gould, Smith, Edell, Welter & Schmidt

[57] ABSTRACT

A hair brush having bristles attached to a member which is rotatable with respect to a handle, together with a method of making and assembling a hair brush comprised of only two separate members, is disclosed. A surface on the member is provided between the handle and the bristles. The person holding the handle may apply force with a finger or thumb against the surface to brake as desirable relative motion between the handle and the bristles. A mechanical braking mechanism for providing a constant drag on the relative motion is optional.

1 Claim, 7 Drawing Figures

HAIR BRUSH

This is a continuation-in-part of Ser. No. 649,915, filed Sept. 12, 1984, which was a continuation-in-part of Ser. No. 643,841, filed Aug. 23, 1984, which was a continuation-in-part of Ser. No. 598,518, filed Apr. 9, 1984, all now abandoned.

TECHNICAL FIELD

The present invention is directed to a brush for brushing the hair of humans or animals or some inanimate hair holding object wherein force supplied against tangles in the hair is a consideration and is further directed to a method for making and assembling the brush.

BACKGROUND OF THE INVENTION

Hair brushes have been available for decades. In spite of this fact, the present invention provides features which have not been heretofore known. To appreciate the significance of the present invention, it is helpful to discuss the development of hair brush art.

U.S. Pat. No. 2,123,044 shows a multiple unit brush wherein if the units are sufficiently spaced apart and the holding screws are sufficiently loose, the brushes may rotate with respect to each other and with respect to the handle. In this case, the brushes are either free wheeling or nonrotatable. The free wheeling option is possible only if each brush is sufficiently spaced so that it doesn't interfere with an adjacent brush and if the holding screws are only loosely tightened. Rotary brushes did not progress further than this design until the present invention, and the brush of U.S. Pat. No. 2,123,044 is not now available and likely was not particularly well received because the non-rotatable option is no different from any brush, while the rotatable option is free wheeling which is generally not very useful in a brush.

U.S. Pat. No. 2,183,139 a few years later provided another hair brush having a plurality of cylindrical brushes. These brushes, however, were not rotatable, and the novelty of design was found in the mechanism which allowed brush replacement.

Later art developed in the area of a single cylindrical brush and involved a variety of minor features. For example, U.S. Pat. No. 2,343,782 shows a hair brush having bristles attached in a spiral pattern. U.S. Pat. No. 2,648,082 shows a cylindrical hair brush which is split and can be separated into a pair of semi-cylindrical brushes. A more recent brush is shown in U.S. Pat. No. 3,843,990 wherein the support for the bristles is elastically deformable so that as bristles apply greater force, they may deform at the support and release the tangled hair against which the force is being applied. A more recent disclosure, U.S. Pat. No. 4,076,032, shows a vented cylindrical hair brush for use with blow styling.

Thus, rotatable brushes were recognized at an early date but generally were not developed into a device having any significant advantage over conventional brushes. In fact, the art developed away from rotatable brushes, as evidenced by the deformable support of U.S. Pat. No. 3,843,990. Hence, the present invention is a departure from decades of hair brushes and is actually an improvement over a very early brush.

SUMMARY OF THE INVENTION

The present invention is directed to a hair brush which is rotatable with respect to the handle, rotatable, however, at a speed controllable by the person holding the brush. Consequently, the disadvantage of the early art is overcome and as pointed out hereinafter the advantage of the present invention results in a product usable by not only the average user, but the user who has little grasping strength in his/her hand. The present invention is further directed to a new and improved method of making and assembling a hair brush comprising an assembly of two separate members which rotate freely relative to each other.

In a general sense, the present hair brush comprises a plurality of bristles attached to the first end portion of a shaft. A mechanism is provided for a handle at the second end portion of the shaft. Since movement of the brush through the hair causes rotation of the bristle carrying member with respect to the handle, further mechanism is provided for applying a rotational braking force of the bristle carrying member with respect to the handle.

More particularly, in the preferred embodiment the bristles are attached to a shaft and the handle is rotatably attached to the shaft. A space between the bristle portion and the handle portion of the brush provides a surface against which one may apply force with his/her finger. The speed of rotation is determined by the degree of knotting or entanglement of the hair, as well as the amount of force applied to the surface. Thus, one may allow the brush to free wheel in order to relieve any pain due to bristles contacting an entanglement. More desirably, however, one may brake the rotation to a comfortable degree of pulling of the hair so that some force may be applied to the entanglement and, by way of continued brushing, the entanglement may be untangled. Thus, the present invention not only utilizes brush rotation for the purpose of untangling hair at a controlled degree of discomfort, but advantageously includes appropriate mechanism for simply yet reliably achieving that purpose. This is pointed out even more by the possibility of adding an optional feature which provides an adjustable brake mechanism. Such brake would be particularly appropriate for people with arthritis or some other disease or calamity which has resulted in a weakness of grip. In such case, a primary braking could be accomplished by the mechanical braking mechanism, while a secondary braking would still be available by application of a finger or a thumb to the appropriate braking surface.

In the first alternate embodiment, bristles are attached to a core member which is mounted on a shaft integral with or attached to the handle. The core member is retained on the shaft by an end screw or nut which may be turned with respect to a threaded portion at the end of the shaft. The degree of tightness of the end screw or nut provides a constant resistance force to rotation of the core member with respect to the handle. The variable braking is still available by applying force with a finger of the hand holding the handle against a surface of the core member located between the handle and the bristles on the core member.

In the second alternate embodiment, bristles are attached to a core member which is rotatably mounted on a shaft integral with the handle. The core member is retained on the shaft by an end cap integrally provided on the outer end of the shaft. This embodiment illustrates a construction of the present invention which offers a simple assembly of a hair brush comprised of only two separate members. The variable braking is still available by applying force with a finger of the hand holding the handle against a surface of the core member located between the handle and the bristles on the core member.

A new and improved method of making and assembling a hair brush in the second alternate embodiment involves molding the two separate members, a handle with integral shaft having an end cap and a core member, followed by insertion of the end cap while it is hot and pliable into and through a slightly smaller circular opening of one end wall of the core member. Once inserted, the end wall expands returning substantially to its original diameter to retain the core member between the end cap and the handle of the hair brush.

The present hair brush is simple and, thus, can be manufactured inexpensively and made available to the vast majority of common people. Despite its simplicity, however, the brush has incorporated features which the art never considered. This fact is surprising, but leads to the significance of the invention.

In addition to these advantages, other advantages and objects obtained by the invention are more fully explained hereinafter by reference to drawings of the preferred and alternate embodiments and descriptive matter relative thereto. In considering the disclosure, it should be kept in mind that the embodiments disclosed are representative of an advantageous concept and that only the claims limit the extent of the invention.

BRIEF DESCRIPTION OF THE DRAWINGS

FIG. 8 is a cross-sectional view of the first threads of the screw shank and second threads of the core member cavity.

DETAILED DESCRIPTION OF THE PREFERRED EMBODIMENT

Figure 1:
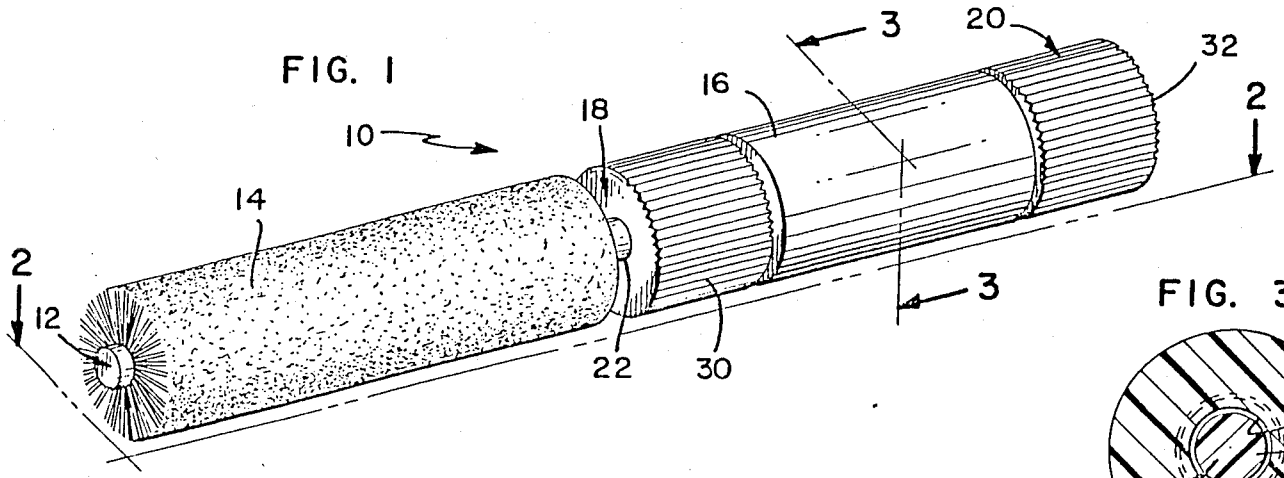
FIG. 1 is a perspective view of a brush in accordance with the present invention.
Figure 3:
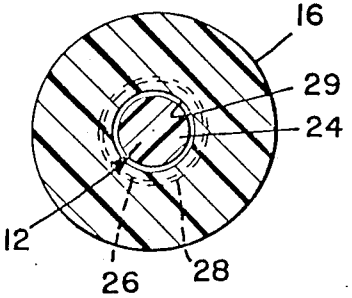
FIG. 3 is a cross-sectional view, taken along line 3—3 of FIG. 1.

Referring now to the drawings wherein like reference numerals designate identical or corresponding parts throughout the several views, and more particularly to FIG. 1, a hair brush in accordance with the preferred embodiment of the present invention is designated generally by the numeral 10. Hair brush 10 includes a shaft 12 having bristles 14 at a first end portion and a handle 16 at an opposite or second end portion. Shaft 12 may be a separate element or may be an integral part of one of the other elements. In FIG. 1, shaft 12 includes a portion 18 between bristles 14 and handle 16 which may be easily touched with a finger so that force may be applied by that finger by the person holding the brush for the purpose of braking relative rotation between the brush portion or bristles 14 and handle 16. In addition, a mechanical mechanism 20 for providing relative braking is shown and is an optional feature of brush 10.

Figure 2:
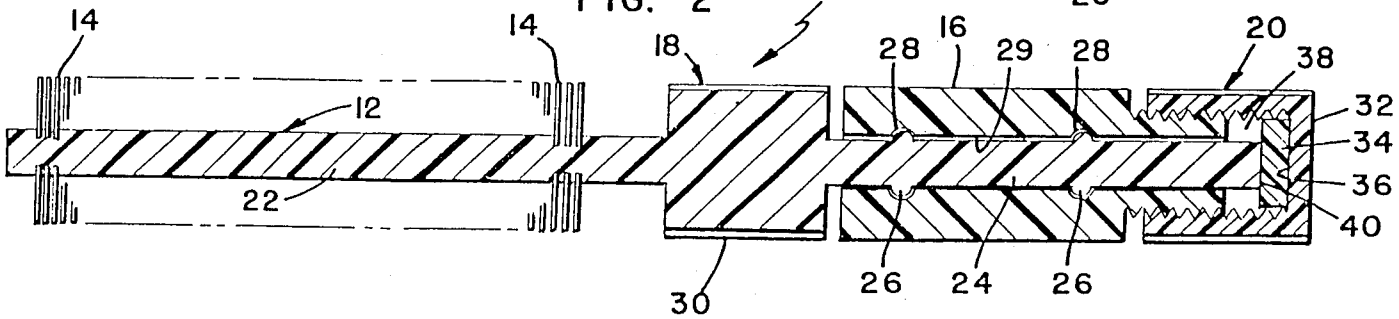
FIG. 2 is a cross-sectional view, taken along line 2—2 of FIG. 1.

As shown in FIG. 2, shaft 12 has a first end portion 22 to which bristles 14 are attached in any of various conventional ways. Shaft 12 at the second or opposite end portion 24 includes a pair of spaced-apart radial enlargements 26. Enlargements 26 are received in a pair of matching cavities 28 in the cylindrical wall of axial passageway 29 in handle 16. Enlargements 26 provide a retaining mechanism for holding handle 16 to shaft 12, and as long as handle 16 fits somewhat loosely with respect to shaft 12, handle 16 is readily rotatable with respect to the shaft. Ease of rotation is enhanced when shaft 12, or at least end portion 24, is made from a material having a relatively low coefficient friction with respect to the material of handle 16. Exemplary materials include nylon and Teflon. Although this present retaining mechanism which allows relative rotation is presently preferred, it is understood that the mechanism disclosed for retaining handle 16 to shaft 12 and allowing rotation relative thereto is only representative of other designs.

Shaft 12 further includes portion 18 located between bristles 14 and handle 16. Portion 18 may be integral with shaft 12 or may be an attached member. Portion 18 preferably has a diameter approximately the same as the size of handle 16, if both are cylindrical. When they are not cylindrical, it is preferably that the general sizes of portion 18 and handle 16 be roughly the same so that the person holding the brush can readily and easily use a finger or thumb to apply a force against surface 30 of portion 18. As shown, it is desirable for portion 18 to have a grooved, knurled, or other roughened surface 30 which will cause a somewhat greater frictional force than would a smooth surface between a finger and portion 18. As indicated, it is understood that portion 18 could assume a variety of shapes and have, as indicated, a variety of surfaces as long as surface fixed to shaft 12 is conveniently available for a finger or thumb to apply pressure against while the remainder of the hand is firmly holding handle 16 in a fashion to make the hair brushing stroke.

Alternatively, handle 16 may be deformable so that on squeezing it, an inside surface causes a frictional braking force against shaft 12. With this embodiment, portion 18 is unnecessary. Such a deformable handle 16 could be deformable, for example, in only specific regions, which may be localized, perhaps in the form of a button, or in circumferential or axially-parallel regions.

Braking mechanism 20 includes an end cap 32 threaded onto the end of handle 16. Preferably, a pad 34 is attached to the inside end 36 of the threaded axial cavity 38 of end cap 32. Pad 34 is essentially a lining material for contacting end 40 of shaft 12. The greater the normal force applied by pad 34 against end 40, the greater is the frictional force or braking of shaft 12 with respect to handle 16. By screwing cap 32 sufficiently tightly, all relative rotation between handle 16 and shaft 12 may be eliminated. The other extreme of the mechanical braking mechanism is to leave cap 32 sufficiently loose so that shaft 12 may free wheel with respect to handle 16 unless pressure is applied by a finger or thumb against surface 30 of enlargement 18. In any case, braking mechanism 20 provides positive mechanical adjustability of the drag on relative motion between handle 16 and shaft 12.

Braking mechanism 20 is not the primary feature of the present invention, but it is an option which is particularly advantageous for persons who can not apply a great deal of force with a finger or thumb to surface 30, such as arthritic people. It is understood that braking mechanism 20 is one embodiment of a mechanical braking mechanism and that other mechanisms having a similar purpose are equivalent if they are capable of applying a braking force adjustable between freewheeling and complete stoppage, either continuously or discretely. In this regard, it is pointed out that cap 32 may be threaded directly onto shaft 12. In this case, it is preferable to eliminate enlargements 26 and cavities 28 so that cap 32 retains handle 16 onto shaft 12 between cap 32 and portion 18 and so that radial surfaces between cap 32 and handle 16 and between handle 16 and portion 18 both serve as frictional or braking surfaces.

Figure 4:
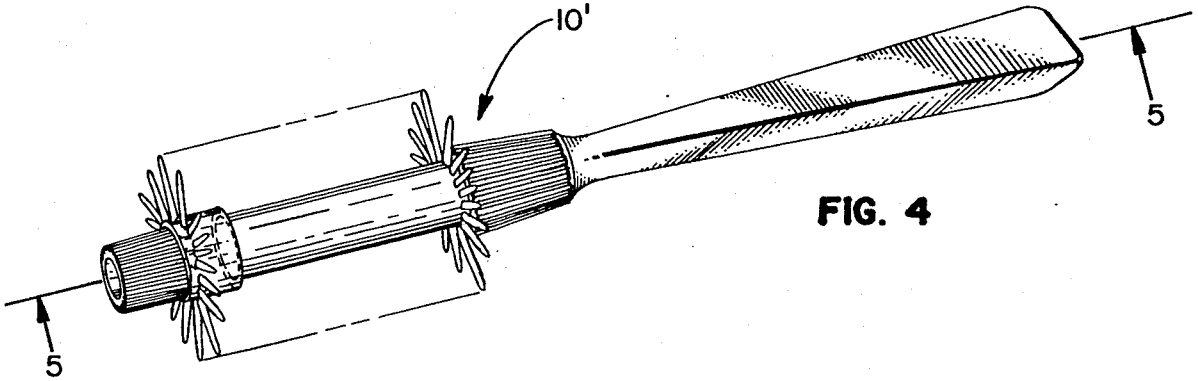
FIG. 4 is a perspective view of the first alternate embodiment of the present invention.
Figure 5:
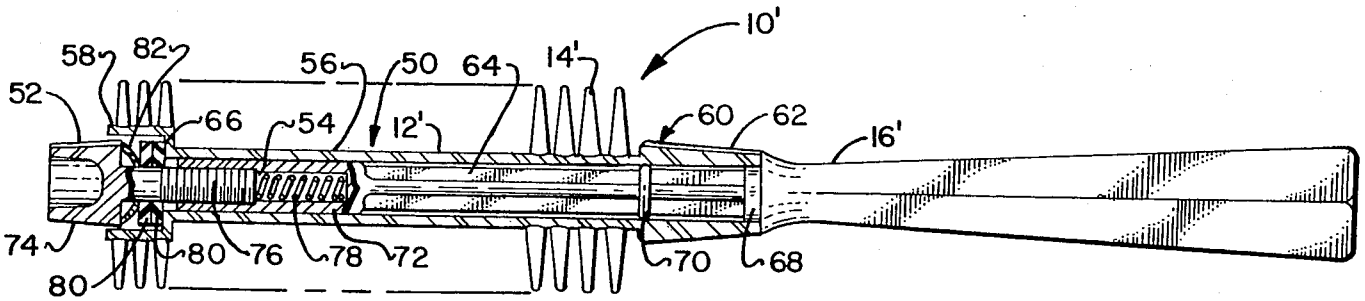
FIG. 5 is a cross-sectional view, taken along line 5—5 of FIG. 4, portions thereof shown in elevational view with portions broken away.

In the first alternate embodiment of FIGS. 4 and 5, parts equivalent to those of the preferred embodiment are designated by the same numerals as for the preferred embodiment only the numerals are primed. Brush 10' includes bristles 14' attached to a rotatable core member 50. Core member 50 is received on shaft 12', an integral extension of handle 16'. End screw 52 is received in threaded cavity 54 of shaft 12' to hold core member 50 on shaft 12'.

Core member 50 has a cylindrical mid-portion 56 having a first diameter. One end portion 58 is also cylindrical, but with a second diameter larger than the first diameter of mid-portion 56. Bristles 14' are glued in cavities or otherwise attached about mid-portion 56 and end portion 58. A second end portion 60 opposite end portion 58 is adjacent to handle 16' when core member 50 is assembled. End portion 60 has an outer surface 62 which is slanted toward handle 16' for convenient touching and application of force by a finger of a hand holding handle 16'. Preferably, surface 62 is knurled. Core member 50 includes an axially aligned, cylindrical passageway 64. Passageway 64 has a first diameter through end portion 60 and mid-portion 56 and a greater second diameter through end portion 58 with a radial, inner surface 66 separating the two diameters.

Handle 16' includes shaft 12' integral therewith or fastened thereto but in any case extending from one end of handle 16' into passageway 64 of core member 50. Shaft 12' preferably has a plurality of portions having diameters only slightly less than the diameter of passageway 64. In the embodiment of FIG. 5, shaft 12' includes an increased diameter end portion 68 adjacent to handle 16', an increased diameter mid-portion 70 spaced from end portion 68, and an elongated end portion 72 having the increased diameter for a length greater than threaded cavity 54. Increased diameter portions 68, 70 and 72 provide stability for core member 50 as it rotates with respect to handle 16'.

Core member 50 is retained on shaft 12' with end screw 52. Screw 52 includes a head 74 and a threaded shank 76. Shank 76 is sized to thread into threaded cavity 54. A coil spring 78 is optional and is compressed between the end of shank 76 and the bottom end of threaded cavity 54. Spring 78 functions to force the threads of screw 52 and cavity 54 together to frictionally resist turning off of screw 52 and resultant loosening of core member 50 with respect to shaft 12' and handle 16'.

A pair of washers or pads 80 and a spring member 82 are located between head 74 of screw 52 and radial surface 66 of core member 50. Pads 80 may be metallic or may be compressible to provide a braking surface in contact with radial surface 66. Spring member 82 provides a range of adjustability of the force on pads 80 and, consequently, the braking drag on core member 50 with respect to handle 16'. The braking drag provided by end screw 52 is a constant drag on core member 50 and may be augmented by applying a finger force on surface 62.

Figure 6:
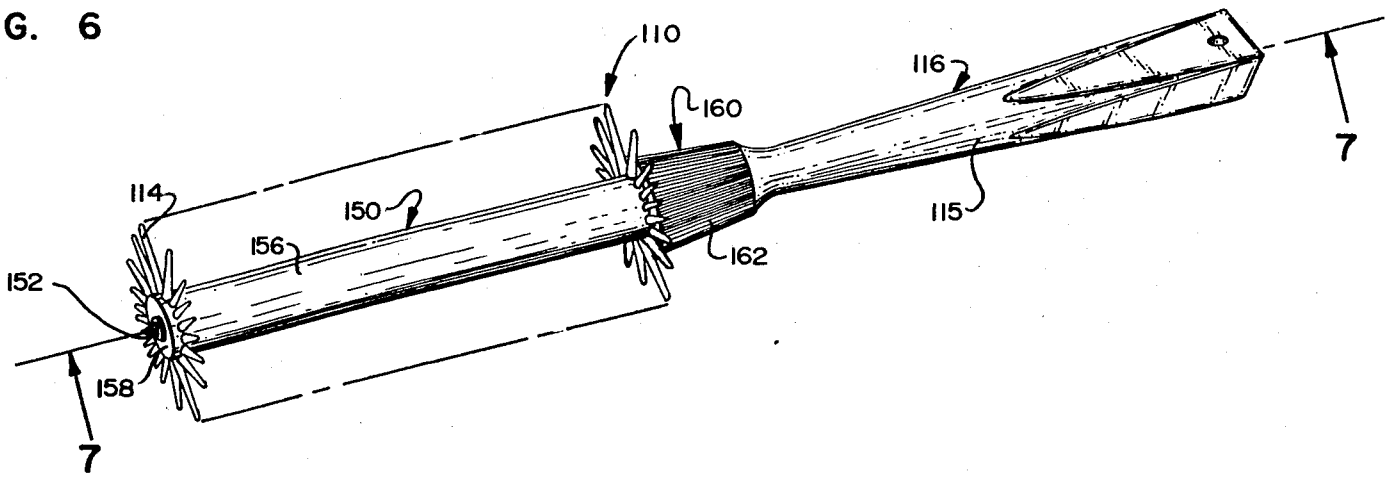
FIG. 6 is a perspective view of the second alternate embodiment of the present invention.
Figure 7:
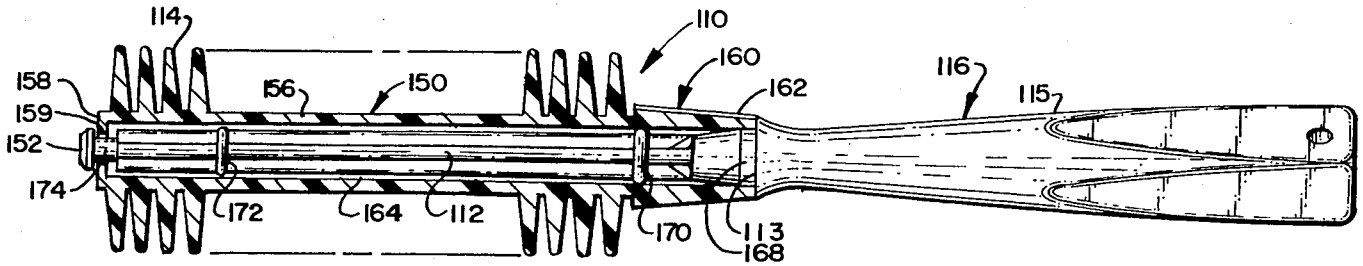
FIG. 7 is a cross-sectional view, taken along line 7—7 of FIG. 6, portions thereof shown in elevational view with portions broken away.

Referring now to FIGS. 6 and 7, a hair brush 110 is shown, as a second alternate embodiment of the present invention. Brush 110 includes bristles 114 attached to a rotatable core member 150. Core member 150 is received on shaft 112, an integral extension of handle 116. Integral with the end of the shaft 112 and opposite the handle 116, there is included an end cap 152 which retains core member 150 on the shaft 112.

Core member 150 has a cylindrical mid-portion 156 which bristles 114 are integrally formed. Axially aligned within the core member 150 is a cylindrical passageway 164. One end of the core member 150, being opposite the handle 116 when core member is assembled thereon, comprises an end wall 158 having a circular opening 159 of a lesser diameter than that of the diameter of the cylindrical passageway 164 and being axially aligned therewith. The other end of the core member 150, being adjacent to the handle 116 when core member is assembled thereon, comprises a braking control portion 160. Braking control portion 160 has an outer surface 162 which is slanted toward handle 116 for convenient touching and application of force by a finger of a hand holding handle 116. Preferably, surface 162 is knurled.

Handle 116 includes shaft 112 integral therewith and extending from a shoulder 113 at one end of a grip portion 115. Shaft 112 extends into passageway 164 of core member 150. Shaft 112 preferably has a bearing portion with a plurality of circular ribs having diameters only slightly less than the diameter of passageway 164. In the embodiment of FIG. 7, shaft 112 includes a maximum tranverse dimension in the form of an increased diameter end portion 168 adjacent to handle 116, and increased diameter or maximum transverse dimension on two spaced apart ribs 170 and 172 longitudinally spaced from end portion 168, with such increased diameter portions 168, 170 and 172 providing stability for core member 150 as it rotates with regard to handle 116.

Core member 150 is retained on shaft 112 with end cap 152. Extending from the end opposite the handle 116, shaft 112 includes a cylindrical extension 174 having a diameter only slightly less than the diameter of the circular opening 159 of the end wall 158 of the core member 150. When assembled, cylindrical extension 174 protrudes through end wall 158 of core member 150. An end cap 152, having a diameter greater than the diameter of the circular opening 159 of the end wall 158 of the core member 150, is integrally provided on the outer end of the cylindrical extension 174 to retain the core member 150 to the shaft 112.

The present invention also encompasses a method for making and assembling a hair brush 110 comprising an assembly of two separate members which rotate freely relative to each other, in accordance with the construction illustrated by the second alternate embodiment shown in FIGS. 6 and 7. The first member comprises the handle 116 with integral shaft 112, cylindrical extension 174 and end cap 152. The second member comprises the core member 150 with integral bristles 114 and further having a braking control portion 160 at one end and an end wall 158 provided with a circular opening 159 at the other end thereof. The method for making and assembling the hair brush 110 comprises the steps of: (a) molding the second member; (b) molding the first member; and (c) inserting the shaft 112 of the first member into the cylindrical passageway 164 of the second member while the first member is hot and pliable, so that the end cap 152 thereof readily deforms to squeeze and pass through the circular opening 159 of the second member, following which the end cap 152 expands to return to substantially its original diameter thereby retaining the second member between the end cap 152 and the handle 116 of the first member.

In use, brush 10 is grasped in one hand at handle 16. Cap 32 is turned so as to apply a selected force between pad 34 and end 40 of shaft 12. That is, braking mechanism 20 is set to apply a desired braking or frictional force as a rotational drag on the relative motion between handle 16 and shaft 12. A finger or thumb is pressed against surface 30 of portion 18 as the brush 10 is stroked through hair. When the bristles 14 encounter a tangle, e.g., some of the pressure or force on surface 30 is released so that a small amount of rotational movement is allowed between handle 16 and shaft 12. That is, the engagement between bristles 14 and the tangled hair is made less severe as bristles 14 rotate to the degree desired through the entangled area. In this way, only as much force is exerted on the entangled hair as is comfortable. With repeated stroking, the entangled hair is eventually untangled and in a fashion which does not leave the scalp sore from pulling hair excessively. Thus, the present hair brush provides both an adjustable, mechanical braking mechanism 20 at a drag level which allows bristles 14 to exert some force against hair and a surface 30 against which the person holding the brush may apply force or pressure with a finger or thumb to exert additional braking against relative motion between the bristles 14 and handle 16.

The first alternate embodiment 10' functions quite similarly to preferred embodiment 10. In particular, handle 16' is grasped in one hand. Screw member 52 is turned until spring 82 is compressed so as to apply a desired force through pads 80 against radial surface 66 of core member 50 and, consequently, to apply a desired rotational drag on core member 50, including bristles 14', with respect to handle 16'. As with brush 10, additional braking can be applied as desired by touching a finger from the hand holding handle 16' against surface 62.

The second alternate embodiment 110 functions quite similarly to the preferred embodiment 10 and the first alternate embodiment 10', with the exception that this embodiment is not provided with an adjustable mechanical braking mechanism. As with the other embodiments, handle 116 is grasped in one hand, and manual braking of the relative rotation between the core member 150 and the handle 116 is achieved by touching a finger or thumb from the hand holding the handle 116 against the surface 162 of the braking control portion 160 of the core member 150.

The present hair brush is particularly advantageous for brushing human hair and animal hair. The brush, however, is also appropriate for use on wigs and perhaps other inanimate items wherein it is desirable not to exert an excessive force against entanglement in the hair or similar material.

Thus, although preferred and alternate embodiments have been described in detail and other alternate or optional features have been indicated, as well as advantages of the various elements and features set forth, it is understood that the present disclosure is exemplary and that additional changes and embodiments are possible. For example, shaft 12' could extend beyond midportion 56 of core member 50 and have male threads on which to receive a female threaded nut which could be threaded against pad 80 and radial surface 66 as described hereinbefore. Also, the threads between the screw or nut and the threads on shaft 12' may not necessarily mate, but may interfere so as to offer greater frictional resistance to unthreading. In such case, it would be unlikely that spring 78 would be necessary. With respect to surface 62 which is available for touching with a finger and braking the rotation of core member 50 with respect to handle 16', in a broad sense it is understood that there could alternatively be a movable member retained directly in handle 16' for pressing against a portion of core member 50 in the alternate embodiment or shaft 12 in the preferred embodiment. In view of the many possible embodiments, it is understood that changes made, especially in matters of shape, size and arrangement, to the full extent extended by the general meaning of the terms in which the appended claims are expressed, are within the principle of the present invention.

What is claimed is:

1. A hair brush, comprising:

a one-piece handle having a grip portion and a shaft portion, said handle having a shoulder separating said grip portion and said shaft portion, said shaft portion including a bering portion and an end portion, said bearing portion including at least a pair of spaced apart ribs, said ribs having a maximum transverse diameter, said end portion having a cylindrical portion with a first diameter less than said maximum transverse diameter of said ribs, said end portion also having an end cap attached to said cylindrical portion and having a second diameter greater than said first diameter; and a one-piece core member having a bristle portion and a braking control portion, said core member including a plurality of bristles integrally extending radially outwardly from said bristle portion, said braking control portion having an end abutting said shoulder, said core member having a cylindrical passage for receiving said shaft portion, said core member having an end wall opposite from said braking control portion end for partially closing said cylindrical passage, said end wall having a circular opening centered on the same axis as said cylindrical passage, said ribs of said bearing portion of said handle being spaced from said end wall, said circular opening for receiving said cylindrical portion of said shaft portion and having a third diameter less than the second diameter of said end cap, said handle being free to rotate with respect to said circular opening of said end wall;

so that said shaft portion fits within said cylindrical passage to allow said core member to rotate on said ribs, said cylindrical portion fitting through said circular opening, said core member being retained for rotation between said shoulder and said end cap, thereby creating said hair brush with a rotatable core member from only two different one-piece members.

* * * * *